US008350762B2

(12) United States Patent
Kim

(10) Patent No.: US 8,350,762 B2
(45) Date of Patent: Jan. 8, 2013

(54) MULTI BAND BUILT-IN ANTENNA

(75) Inventor: Byong-Nam Kim, Gyounggi-do (KR)

(73) Assignee: Ace Antenna Corp., Incheon (KR)

( * ) Notice: Subject to any disclaimer, the term of this patent is extended or adjusted under 35 U.S.C. 154(b) by 661 days.

(21) Appl. No.: 12/530,212

(22) PCT Filed: Mar. 10, 2008

(86) PCT No.: PCT/KR2008/001340

§ 371 (c)(1),
(2), (4) Date: Jan. 19, 2010

(87) PCT Pub. No.: WO2008/108607

PCT Pub. Date: Sep. 12, 2008

(65) Prior Publication Data

US 2010/0149069 A1 Jun. 17, 2010

(30) Foreign Application Priority Data

Mar. 8, 2007 (KR) ..... 10-2007-0022850

(51) Int. Cl.
*H01Q 1/24* (2006.01)

(52) U.S. Cl. ..... 343/702; 343/895

(58) Field of Classification Search ..... 343/702, 343/791, 792, 793, 895
See application file for complete search history.

(56) References Cited

U.S. PATENT DOCUMENTS

| | | | | |
|---|---|---|---|---|
| 4,626,862 | A | 12/1986 | Ma | |
| 5,617,105 | A | 4/1997 | Tsunekawa et al. | |
| 5,701,128 | A | 12/1997 | Okada et al. | |
| 6,320,549 | B1 | 11/2001 | Nybeck et al. | |
| 6,842,155 | B1 * | 1/2005 | Yeh | 343/790 |
| 6,963,313 | B2 * | 11/2005 | Du | 343/790 |
| 7,843,394 | B2 * | 11/2010 | Egawa et al. | 343/702 |
| 2003/0117333 | A1 * | 6/2003 | McLean | 343/790 |

FOREIGN PATENT DOCUMENTS

| | | | |
|---|---|---|---|
| DE | 4321233 | A1 | 5/1994 |
| EP | 0822609 | A1 | 2/1998 |
| WO | 98/10485 | A1 | 3/1998 |
| WO | 9810485 | A1 | 3/1998 |
| WO | 2006/062060 | A1 | 6/2006 |
| WO | 2006062060 | A1 | 6/2006 |

OTHER PUBLICATIONS

International Search Report & Written Opinion for PCT/KR2008/001340.

(Continued)

*Primary Examiner* — Tan Ho
(74) *Attorney, Agent, or Firm* — LRK Patent Law Firm

(57) ABSTRACT

A multi-band built-in antenna for a mobile communication terminal having a main board and a casing for protecting the main board, is disclosed. A transmission line is formed to be spaced apart from one outside surface of the main board by a predetermined interval and configured to include an external conductor, a dielectric, and a central conductor so as to transmit signals. A ground clip is configured to ground the transmission line by fastening the transmission line. A radiator is formed by bending the dielectric and central conductor of the transmission line, other than the external conductor of the transmission line, and is configured to operate in multiple bands. An open stub is connected to the ground clip, is bent a plurality of times, and is configured to be operated in a low frequency band, which is lower than the high frequency band.

26 Claims, 8 Drawing Sheets

OTHER PUBLICATIONS

European Search Report for European Patent Application No. 08723377.1.

SIPO Office Action for Chinese Patent Application No. 200880007569.3.

* cited by examiner

Fig. 13
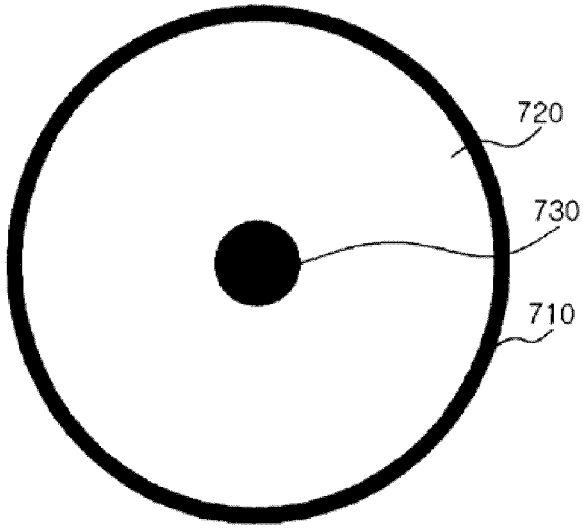
[Fig. 14]
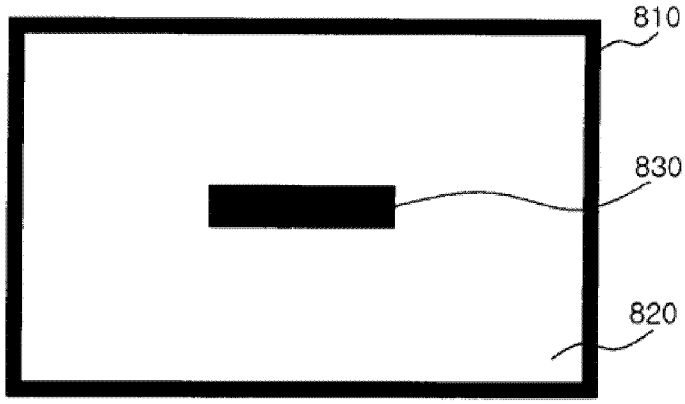
[Fig. 15]
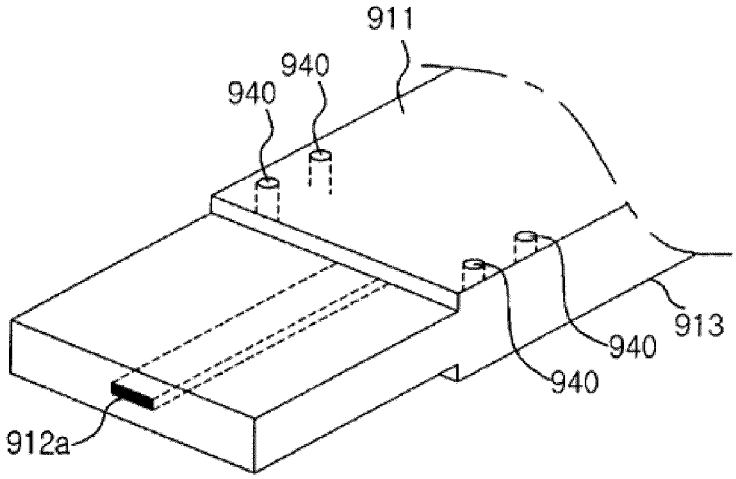

MULTI BAND BUILT-IN ANTENNA

TECHNICAL FIELD multi-band built-in antenna,multi-band built-in antenna which operates in multiple bands by using one end of a transmission line, including an external conductor, a dielectric and a central conductor, as a radiator. This enables easy tuning of antenna characteristics by fastening the transmission line and the main board of a mobile communication terminal using a ground clip, and which enables tuning of antenna characteristics by changing the structure or shape of the ground clip.

BACKGROUND ART

A prior art built-in antenna is a technology in which, in a mobile communication terminal 100 including a main board 110 and a casing 120, a coaxial line 130 for transmitting signals is formed, a forward connector 131 for a coaxial line is formed on one end of the coaxial line 130 and a backward connector 132 for a coaxial line 130 is formed on the other end of the coaxial line 130, a feed line 140 is formed on the backward connector 132 for a coaxial line, and a metal radiator 150, including a carrier 151 configured to receive signals from the feed line 140 and then perform an operation, is provided, as shown in FIG. 1.

In the case of the built-in antenna which uses a coaxial line like the prior art built-in antenna, the coaxial line is used as a transmission path for Radio Frequency (RF) signals, therefore forward and backward connectors for the coaxial line are necessarily and additionally required on both ends of the coaxial line, and a separate built-in antenna is implemented on a side next to that of the forward and backward connectors for the coaxial line.

In particular, in order to use the forward and backward connectors for the coaxial line, a separate Printed Circuit Board (PCB) is additionally required, and a Surface Mount Technology (SMT) must inevitably be implemented on the PCB. This causes problems in that the manufacturing cost increases due to the increase in the processing cost and the increase in the number of components, and the structure of an antenna is complex.

DISCLOSURE OF INVENTION

Technical Problem

Accordingly, the present invention has been made keeping in mind the above problems occurring in the prior art, and an object of the present invention is to provide a multi-band built-in antenna, in which a radiator is implemented by bending only the dielectric and central conductor of a transmission line, other than the external conductor of the transmission line, including the external conductor, the dielectric and the central conductor so as to transmit signals. The transmission line and the main board of a mobile communication terminal are connected using a ground clip, thereby simplifying the structure of an antenna and decreasing the manufacturing cost thereof, and which enables easy tuning of antenna characteristics by changing the structure or shape of the ground clip.

Technical Solution

In order to accomplish the above object, a multi-band built-in antenna for a mobile communication terminal having a main board and a casing for protecting the main board is provided which, according to an embodiment of the present invention, includes a transmission line formed to be spaced apart from one outside surface of the main board by a predetermined interval and configured to include an external conductor, a dielectric, and a central conductor so as to transmit signals; and a radiator formed by bending the dielectric and central conductor of the transmission line, other than the external conductor of the transmission line, and configured to operate in multiple bands.

According to the embodiment of the present invention, a ground clip for grounding the transmission line is formed by fastening the transmission line and the main board, a plastic rib is formed to fix and support the radiator, and the radiator is formed in a meandering line. The radiator is operated in dual bands, and is formed in a meandering line.

A multi-band built-in antenna for a mobile communication terminal having a main board and a casing for protecting the main board is provided which, according to another embodiment of the present invention, includes a transmission line formed to be spaced apart from one outside surface of the main board by a predetermined interval and configured to include an external conductor, a dielectric, and a central conductor so as to transmit signals; a ground clip configured to ground the transmission line by fastening the transmission line; and a radiator formed by bending the dielectric and central conductor of the transmission line, other than the external conductor of the transmission line, and configured to operate in multiple bands.

According to the embodiment of the present invention, the ground clip includes a first open stub formed to be parallel to the transmission line, a dipole structure is formed between the first open stub and the radiator, the first open stub is operated in a mutual coupling with the transmission line, a plastic rib is formed to fix and support the radiator, the radiator is operated in a dual band, and the radiator is formed in a meandering line.

A multi-band built-in antenna for a mobile communication terminal having a main board and a casing for protecting the main board is provided which, according to still another embodiment of the present invention, includes a transmission line formed to be spaced apart from one outside surface of the main board by a predetermined interval and configured to include an external conductor, a dielectric, and a central conductor so as to transmit signals; a ground clip configured to ground the transmission line by connecting the transmission line and the main board; a radiator formed by bending the dielectric and central conductor of the transmission line, other than the external conductor of the transmission line, and configured to operate in multiple bands; and a second open stub formed on the ground clip.

According to the embodiment of the present invention, the second open stub is formed to be symmetrical to the radiator, and part of one end of the second open stub is connected to the radiator, a folded dipole structure is formed between the second open stub and the radiator, a plastic rib is formed to fix and support the radiator, the radiator is operated in a dual band, the radiator is formed in a meandering line, the external conductor is formed to cover the radiator, and the radiator is operated in a mutual coupling with the external conductor.

A multi-band built-in antenna for a mobile communication terminal having a main board and a casing for protecting the main board is provided which, according to a further embodiment of the present invention, includes a transmission line formed along one side of the main board, and configured to include an external conductor, a dielectric, and a central conductor so as to transmit signals; a ground clip configured to ground the transmission line by connecting the transmission line and the main board; a radiator formed by bending the dielectric and central conductor of the transmission line, other than the external conductor of the transmission line, and configured to operate in a high frequency band; and a third open stub connected to the ground clip, bent a plurality of times, and configured to be operated in a low frequency band, which is lower than the high frequency band; wherein the radiator is spaced apart from the third open stub by a predetermined interval to be parallel thereto, and is configured to perform coupling feeding to the third open stub.

According to the embodiment of the present invention, broadband resonance characteristics occur in a low frequency band, in which the third open stub operates, depending on the interval between the third open stub and the radiator and a length of the radiator.

According to the embodiment of the present invention, the transmission line is a coaxial line in which the cross sections of the external conductor, the dielectric, and the central conductor are formed in a circular shape, and the signals are transmitted through the central conductor.

According to the embodiment of the present invention, a transmission line is formed of a strip line in which the cross sections of the external conductor, the dielectric, and the central conductor are formed in a square shape, the external conductor is formed to be a ground surface, the signals are transmitted through the central conductor provided in the center of the transmission line, and the external conductor and the central conductor are supported by the dielectric.

According to the embodiment of the present invention, a first flexible Printed Circuit Board (PCB), a second flexible PCB, and a third flexible PCB are vertically layered; the external conductor is formed by connecting conductor surfaces arranged in the outer circumferences of the first flexible PCB and the third flexible PCB, and a plurality of through holes arranged and formed through the first to third flexible PCBs; the central conductor is buried in the center of the second flexible PCB while having a width corresponding to characteristic impedance; and the dielectric is formed by each of the flexible PCB dielectric layers.

According to the embodiment of the present invention, the plurality of through holes is formed by being spaced apart from the central conductor by predetermined intervals and arranged at both end portions of the first to third flexible PCBs so as to be parallel therewith.

Advantageous Effects

The present invention has advantages in that a ground clip is formed to fasten a transmission line and a main board, so that signals are grounded, the transmission line is supported, and easy tuning of antenna characteristics is enabled. A radiator is formed to include the dielectric and the central conductor of the transmission line, other than the external conductor of the transmission line, in case that the transmission line includes the external conductor, the dielectric, and the central conductor, so that the structure of the antenna is simplified. The configuration of an antenna is formed by a ground clip and a radiator using a transmission line, so that the manufacturing cost decreases.

The present invention has an advantage in that an open stub is formed on a ground clip for grounding a main board and a transmission line, and the open stub is operated together with a radiator formed by the dielectric and the central conductor of the transmission line, without the external conductor of the transmission line, so that the resonance characteristics of a low frequency band are further improved, thereby obtaining broadband characteristics.

BRIEF DESCRIPTION OF THE DRAWINGS

FIG. 13 is a view showing an embodiment of a transmission line according to the present invention;

FIG. 14 is a view showing another embodiment of a transmission line according to the present invention;

FIG. 15 is a view showing still another embodiment of a transmission line according to the present invention.

MODE FOR THE INVENTION

Preferred embodiments of the present invention will be described in detail with reference to the attached drawings below.

Figure 1:
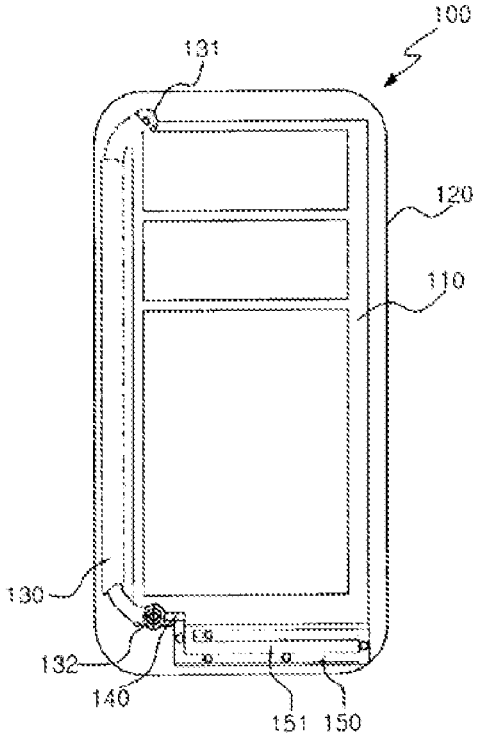
FIG. 1 PRIOR ART
FIG. 1 is a view showing the configuration of a prior art built-in antenna.
Figure 2:
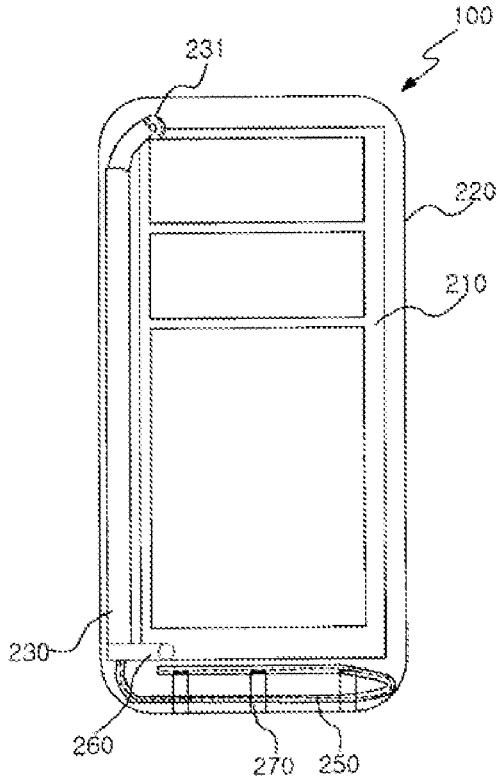
FIG. 2 is a view showing the configuration of a multi-band built-in antenna according to an embodiment of the present invention.
Figure 3:
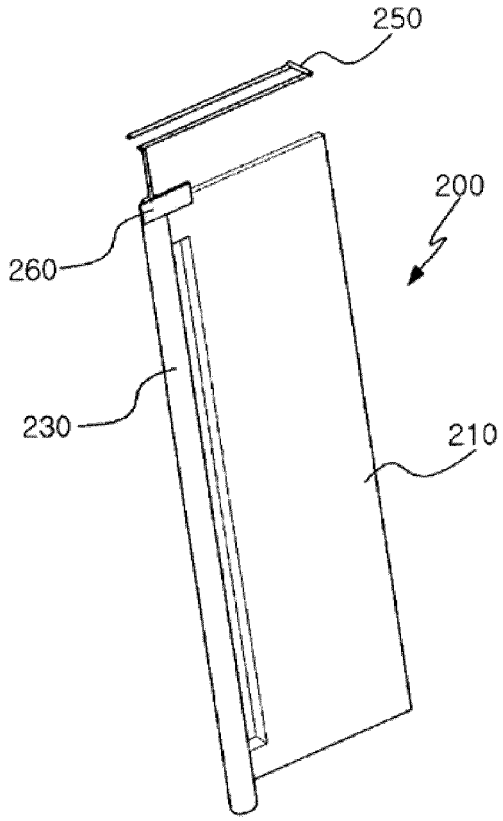
FIG. 3 is a perspective view showing the multi-band built-in antenna of FIG. 2 according to the present invention.

FIG. 2 is a view showing the configuration of a multi-band built-in antenna according to an embodiment of the present invention, and FIG. 3 is a perspective view showing the multi-band built-in antenna of FIG. 2 according to the present invention. In a mobile communication terminal 200 including a main board 210 and a casing 220 for protecting the main board 210, the multi-band built-in antenna includes a transmission line 230, formed to be spaced apart from the outside surface of the main board 210 by a predetermined interval and configured to include an external conductor, a dielectric, and a central conductor so as to transmit signals, and a radiator 250 formed by bending the dielectric and central conductor of the transmission line 230, without the external conductor of the transmission line 230 and configured to operate in multiple bands.

Further, a ground clip 260 for grounding the transmission line 230 by fastening the transmission line 230 and the main board 210, and a plastic rib 270 for fixing and supporting the radiator 250 are respectively formed.

In further detail, the external conductor is formed on the outer circumference of the transmission line 230 in a circular shape, the dielectric is formed inside the external conductor, and the central conductor is formed inside the dielectric.

A forward connector 231 for the transmission line is formed on one end of the transmission line 230, and transmits signals, supplied from the outside, to the transmission line 230.

The radiator 250 is formed by removing the external conductor of the transmission line 230 and bending only the dielectric and the central conductor a plurality times, and is operated in a dual frequency band thanks to being bent a plurality of times.

Further, the design of the radiator 250 may be changed and then used so as to be operated in multiple bands by implementing it not in the form of a simple bend but in the form of a meandering line.

Furthermore, with regard to the electrical length of the radiator 250, in the case of a low frequency band, a resonance frequency is determined based on the total length of the radiator 250 including only the dielectric and central conductor of the transmission line 230, without the external conductor of the transmission line 230, corresponding to a length of $\lambda/4$. In the case of a high frequency band, a resonance frequency is determined based on the length from the first end of the radiator 250, including only the dielectric and central conductor of the transmission line 230, without the external conductor of the transmission line 230, to the portion of the radiator 250 where the radiator 250 is bent.

The dielectric formed in the transmission line 230 prevents short-circuit between the external conductor and the central conductor and decreases the resonance frequency attributable to permittivity.

The plastic rib 270 is formed of a plastic material which is not conductive, and a plurality of plastic ribs is provided in order to fix and support the radiator 250.

Figure 4:
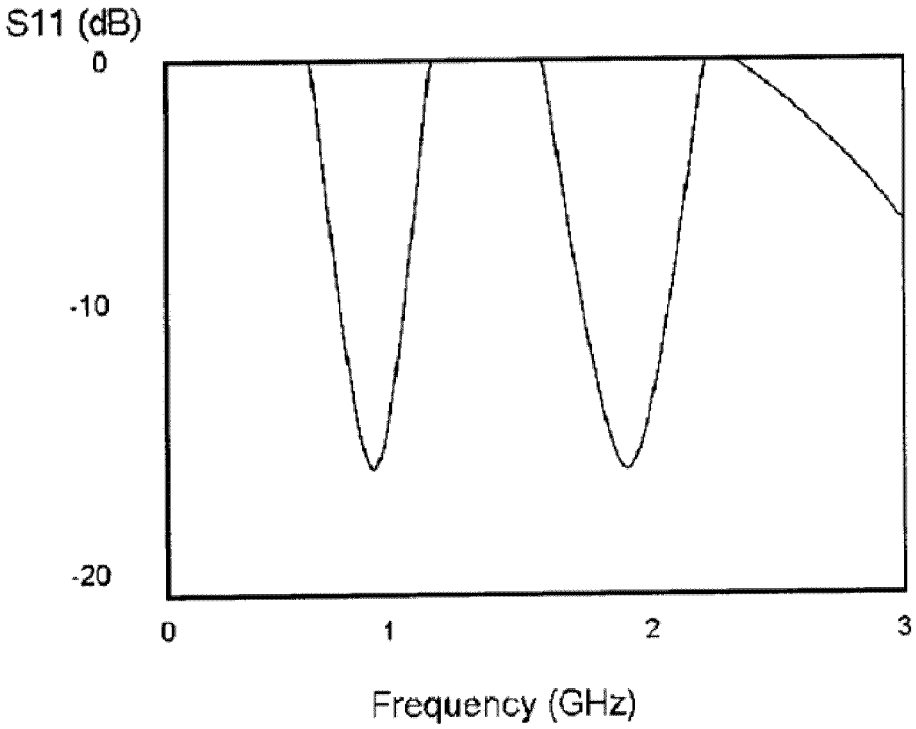
FIG. 4 shows the reflection loss of the multi-band built-in antenna of FIG. 3 according to the present invention.

FIG. 4 shows the analysis results of the reflection loss of the embodiment of FIG. 3 according to the present invention. It can be seen that analysis results of 180 MHz and 120 MHz can be obtained based on a reflection loss of −6 dB. According to the results, it can be seen that the performance of the present antenna can be used as a built-in antenna for a multi-band terminal, which is required at present.

Figure 5:
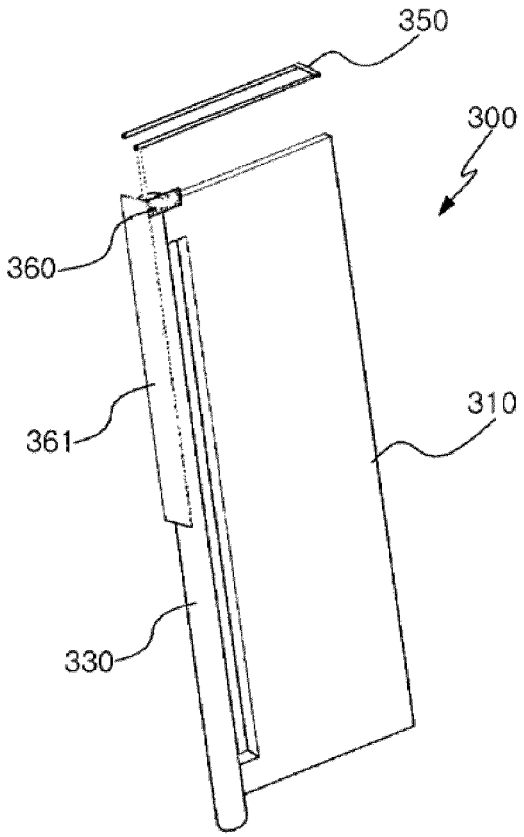
FIG. 5 is a perspective view showing a multi-band built-in antenna according to an embodiment of the present invention.

FIG. 5 is a perspective view showing the multi-band built-in antenna according to an embodiment of the present invention. A multi-band built-in antenna for a mobile communication terminal 300 having a main board 310 and a casing 320 for protecting the main board 310 is provided, which includes a transmission line 330 formed to be spaced apart from one outside surface of the main board 310 by a predetermined interval and configured to include an external conductor, a dielectric, and a central conductor so as to transmit signals, a ground clip 360 for grounding the transmission line 330 by fastening the transmission line 330 and the main board 310, and a radiator 350 formed by bending the dielectric and central conductor of the transmission line 330, without the external conductor of the transmission line 330, and configured to operate in multiple bands.

In further detail, the ground clip 360 includes a first open stub 361 formed parallel to the transmission line 330. The structure formed between the first open stub 361 and the radiator 350 ultimately forms a dipole structure.

The first open stub 361 is formed to be adjacent to the transmission line 330, and operated in mutual coupling with the transmission line 330, so that the effective length of the first open stub 361 decreases.

Further, the preferable electrical length of the first open stub 361 is such that the length of the first open stub 361 is $0.15\lambda$ and the width of the first open stub 361 is $0.026\lambda$.

The radiator 350 is bent a plurality of times and operated in multiple bands, and the first open stub 361 is operated in mutual coupling with the transmission line 330, thereby broadening the low frequency resonance band in the frequency band in which the radiator 350 operates.

Figure 6:
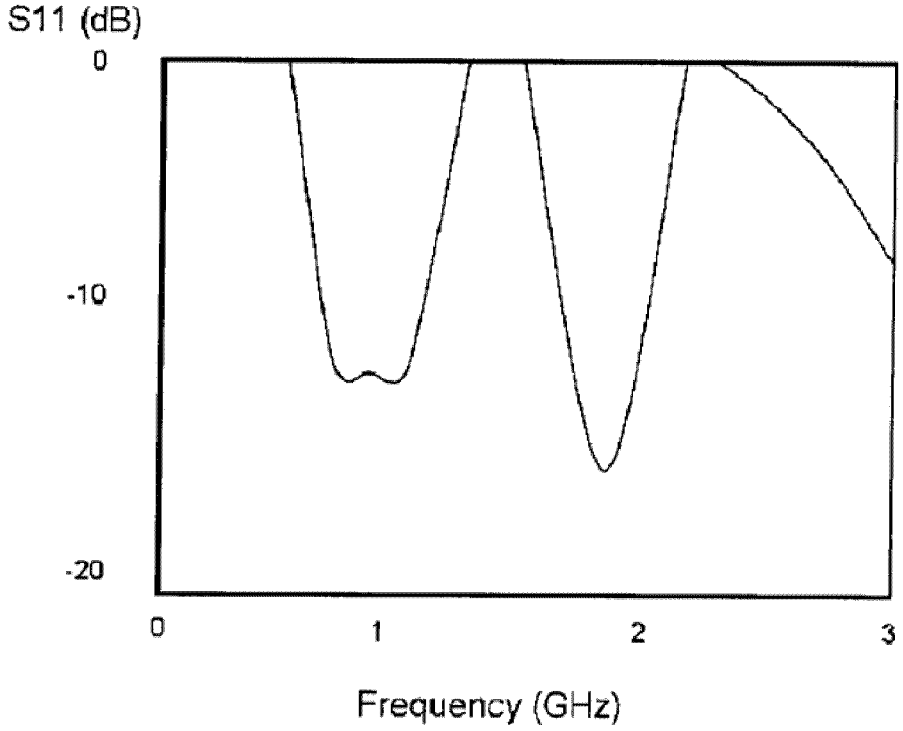
FIG. 6 shows reflection loss based on the embodiment of FIG. 5 according to the present invention.

FIG. 6 shows the analysis results of the reflection loss of the embodiment of FIG. 5 according to the present invention. In particular, it can be seen that the low frequency resonance characteristics in the 1 GHz band are well matched, compared to the case of FIG. 4. This result shows the effect of the insertion of the first open stub 361, and it can be seen that broadband characteristics in the 1 GHz band, in which the first open stub operates, can be obtained like the analysis result.

Figure 7:
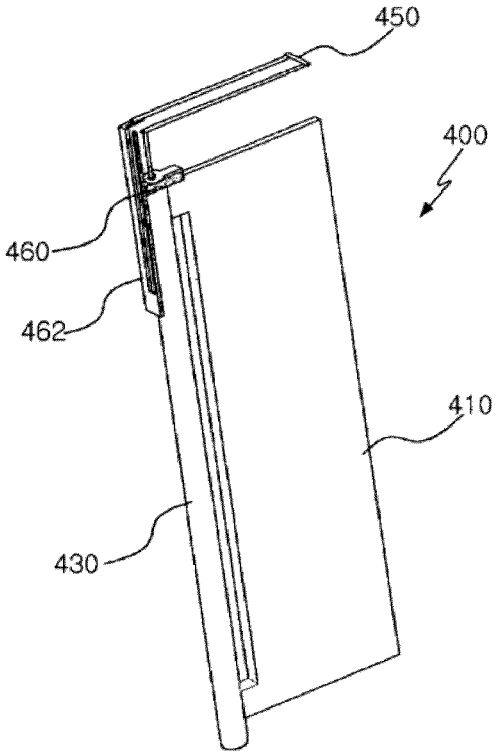
FIG. 7 is a perspective view showing a multi-band built-in antenna according to another embodiment of the present invention.

FIG. 7 is a perspective view of a multi-band built-in antenna according to another embodiment of the present invention. A multi-band built-in antenna for a mobile communication terminal 400 having a main board 410 and a casing 420 for protecting the main board 410 is provided, which includes a transmission line 430 formed to be spaced apart from one outside surface of the main board 410 by a predetermined interval and configured to include an external conductor, a dielectric, and a central conductor so as to transmit signals, a ground clip 460 configured to ground the transmission line 430 by connecting the transmission line 430 and the main board 410, a radiator 450 formed by bending the dielectric and central conductor of the transmission line 430, without the external conductor of the transmission line 430, and configured to operate in multiple bands, and a second open stub 462 formed on the ground clip 460.

In further detail, the second open stub 462 is formed to be symmetrical to the radiator 450, and part of one end of the second open stub 462 is connected to the radiator 450.

Further, the second open stub 462 is fastened to the radiator 450, so that they ultimately form a folded dipole structure.

In addition, it is most preferable that the second open stub 462 be formed to have a width of $0.006\lambda$ and a length of $0.25\lambda$.

Figure 8:
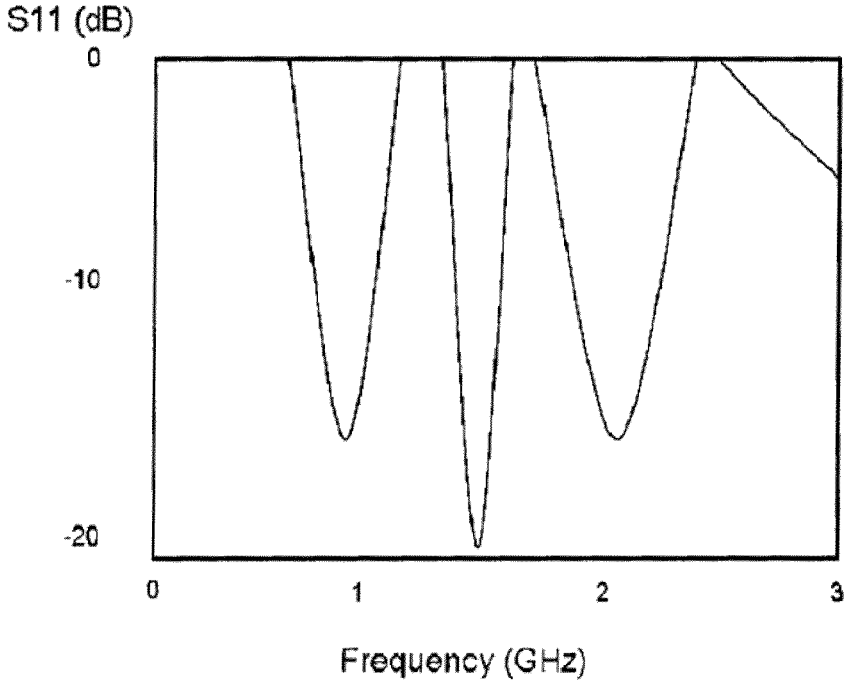
FIG. 8 shows reflection loss based on the embodiment of FIG. 7 according to the present invention.

FIG. 8 shows the analysis result of the reflection loss of the embodiment of FIG. 7 according to the present invention, in which it can be seen that triple resonance characteristics appear due to the insertion of the second open stub. Therefore, as in a product which needs respective independent triple bands, such as Code division multiple access (CDMA)/Global Positioning System (GPS)/United States Personal Communications Service (USPCS) bands, the utilization can be increased using a built-in antenna for various other multi-band terminals based on the structural change as in FIG. 8.

Figure 9:
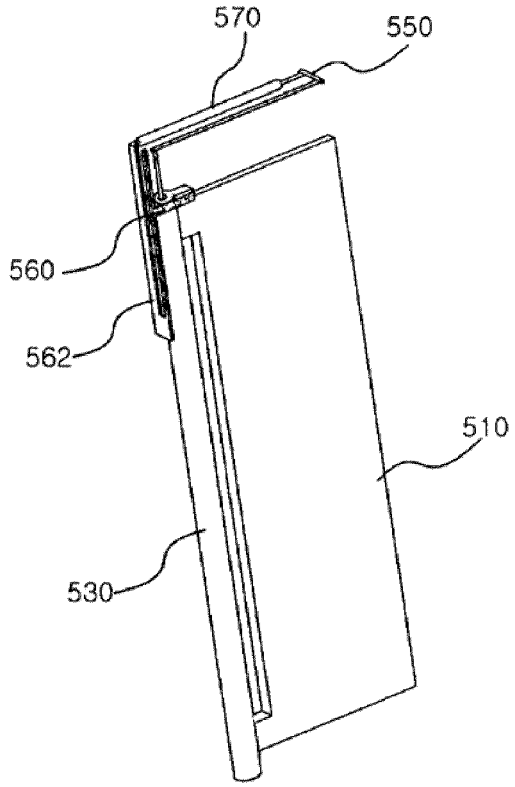
FIG. 9 is a perspective view showing a radiator, in which an external conductor is formed according to another embodiment of the present invention.

FIG. 9 is a perspective view of a multi-band built-in antenna according to another embodiment of the present invention in which an external conductor is formed. A multi-band built-in antenna for a mobile communication terminal 500 having a main board 510 and a casing 520 for protecting the main board 510 is provided, which includes a transmission line 530 formed to be spaced apart from one outside surface of the main board 510, and configured to include an external conductor, a dielectric, and a central conductor so as to transmit signals, a ground clip 560 configured to ground the transmission line 530 by connecting the transmission line 530 and the main board 510, a radiator 550 formed by bending the dielectric and central conductor of the transmission line 530, without the external conductor of the transmission line 530, and configured to operate in multiple bands, a second open stub 562 formed on the ground clip 560, and an external conductor 570 for covering a predetermined part of the radiator.

The second open stub 562 is formed to be symmetrical to the radiator 550, and part of one end of the second open stub 562 is connected to the radiator 550.

In further detail, the external conductor 570 is formed on one end of the radiator 550 by removing a length equal to 0.1λ of the external conductor of the transmission line 530 to cover the radiator 550.

Further, the external conductor 570 is operated in mutual coupling with radiator 550, thereby improving the bandwidth of the antenna.

Figure 10:
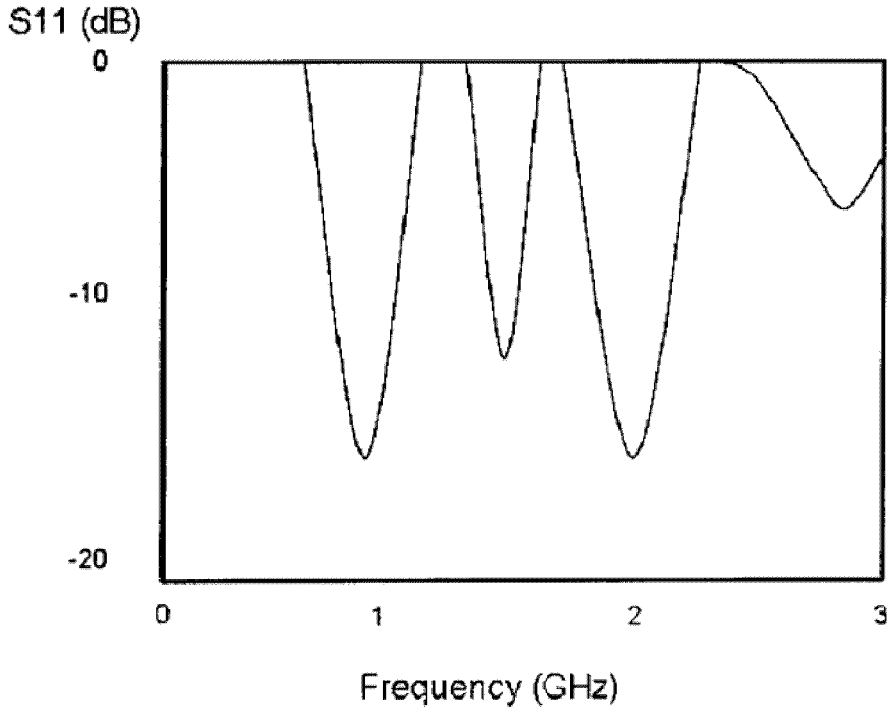
FIG. 10 shows reflection loss based on the embodiment of FIG. 9 according to the present invention.

FIG. 10 shows the analysis result of the reflection loss of the embodiment of FIG. 9 according to the present invention, in which the broadband characteristics at a high frequency (2.1 GHz) and additional resonance characteristics at 3 GHz can be observed due to the insertion of the external conductor 570.

Figure 11:
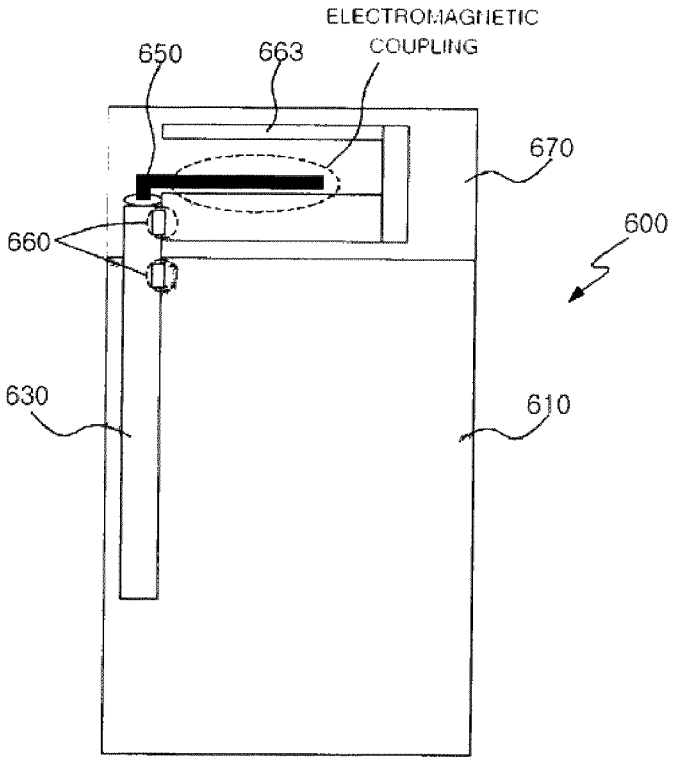
FIG. 11 is a view showing the configuration of a multi-band built-in antenna according to another embodiment of the present invention.

FIG. 11 is a view showing the configuration of a multi-band built-in antenna according to still another embodiment of the present invention. As shown in FIG. 11, a multi-band built-in antenna for a mobile communication terminal 600 having a main board 610 and a casing for protecting the main board 610 is provided, which includes a transmission line 630 formed along one side of the main board 610, and configured to include an external conductor, a dielectric, and a central conductor so as to transmit signals, a ground clip 660 configured to ground the transmission line 630 by connecting the transmission line 630 and the main board 610, a radiator 650 formed by bending the dielectric and central conductor of the transmission line 630, without the external conductor of the transmission line 630, and configured to operate in a high frequency band, and a third open stub 663 connected to the ground clip 660, bent a plurality of times, and operated in a low frequency band which is lower than the high frequency band. The radiator 650 is spaced apart from the third open stub 663 by a predetermined interval so as to be parallel thereto, and is configured to perform coupling feeding to the third open stub 663.

Based on the interval between the third open stub and the radiator, and the length of the radiator, broadband resonance characteristics occur in a low frequency band in which the third open stub operates.

The third open stub 663 may be formed, as shown in FIG. 11, on the clearance surface 670 of the substrate 610, or may be formed by extending and bending the ground clip a plurality of times so that it is spaced apart from the clearance surface 670 by a predetermined height. Therefore, the radiator 650 may be formed on one side of the third open stub 663 so as to be parallel thereto or may be formed on the upper portion of the third open stub 663 to be parallel thereto.

The third open stub 663 is formed to have a meandering line structure.

Capacitor coupling is generated between the third open stub 663 and the radiator 650, so that broadband resonance characteristics appear in a low frequency resonance band, that is, in the resonance band of the third open stub 663.

Metallization can be directly performed on the main board 610 so that the external conductor of the transmission line 630 is directly connected to the main board 610, instead of using the ground clip 660.

Figure 12:
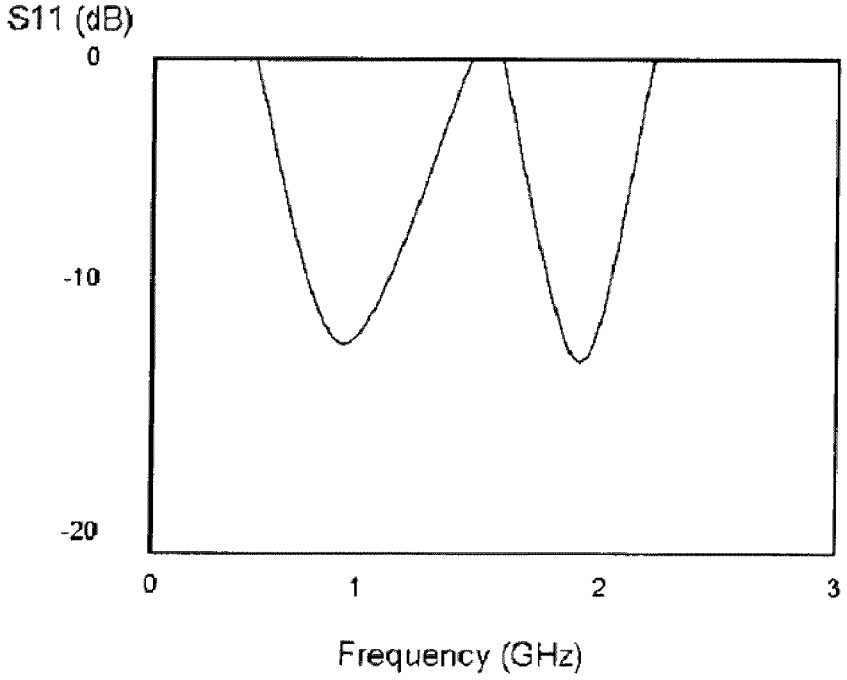
FIG. 12 shows reflection loss based on the embodiment of FIG. 11 according to the present invention.

FIG. 12 shows reflection loss of the embodiment of FIG. 11 according to the present invention. As shown in FIG. 12, in the multi-band built-in antenna of FIG. 11, the radiator 650 is operated in a 2 GHz band, the third open stub 663 is operated in a 1 GHz band, which is a frequency band that is lower than the resonance band of the radiator 650, and the low frequency resonance characteristics in the 1 GHz resonance band are improved due to the capacitor coupling between the radiator 650 and the third open stub 663, so that broadband characteristics can be obtained in the 1 GHz resonance band.

Moreover, the respective transmission lines shown in FIGS. 2, 3, 5, 7, 8, and 11 can be implemented in various forms, as shown in FIGS. 13, 14 and 15.

FIG. 13 shows an embodiment of a transmission line according to the present invention, that is, a view showing the configuration of a coaxial line. The transmission line according to the present invention can be implemented, for example, as a coaxial line in which the cross sections of an external conductor 710, a dielectric 720, and a central conductor 730 are formed in a circular shape, and signals are transmitted through the central conductor 730, as shown in FIG. 13.

FIG. 14 shows another embodiment of a transmission line according to the present invention, that is, a view showing the configuration of a strip line. The transmission line according to the present invention can be implemented, for example, as a strip line in which the cross sections of an external conductor 810, a dielectric 820, and a central conductor 830 are formed in a square shape, the external conductor 810 is formed to be a ground surface, signals are transmitted through the central conductor 830 provided in a center of the inside of the transmission line, and the external conductor 810 and the central conductor 830 are supported by the dielectric 820, as shown in FIG. 14.

Figure 16:
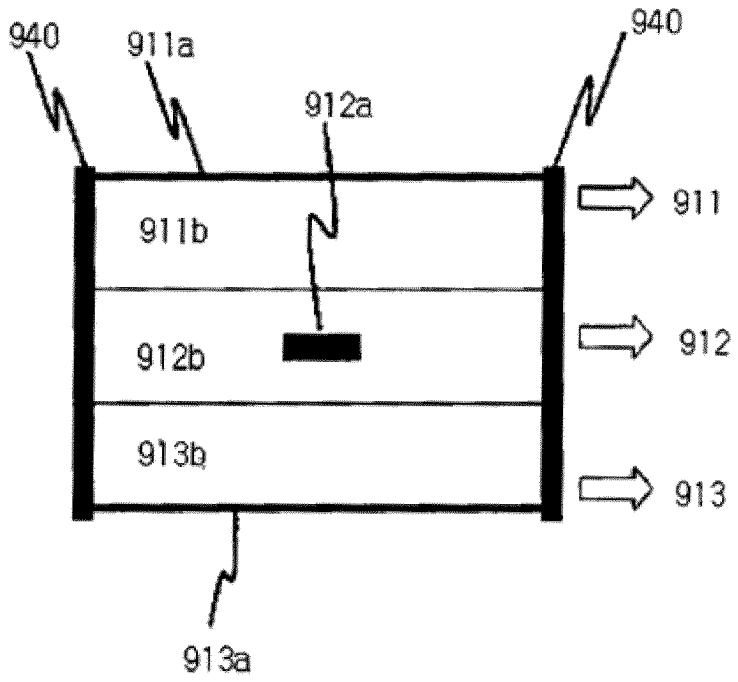
FIG. 16 is a perspective view showing a layered-flexible PCB strip line for the embodiment of FIG. 15 according to the present invention.

FIG. 15 is a perspective view of still another embodiment of a transmission line according to the present invention, and FIG. 16 is a cross-sectional view of the layered-flexible PCB strip line of FIG. 15. The transmission line according to the present invention can be implemented, for example, as a layered, flexible PCB strip line, as shown in FIG. 15. A first flexible PCB 911, a second flexible PCB 912, and a third flexible PCB 913 are vertically layered, an external conductor is formed by connecting a conductor surface 911*a* arranged on the outer circumference of the first layered-flexible PCB 911, a conductor surface 913*a* arranged on the outer circumference of the third layered-flexible PCB 913, and a plurality of through holes 940 arranged and formed through the first to third flexible PCBs 911, 912, and 913. The central conductor is a signal line 912*a* which is formed by being buried in the center of the dielectric layer 912*b* of the second flexible PCB 912 while having the width of the characteristic impedance of a line. The dielectric can be implemented by a flexible PCB strip line, formed by dielectric layers 911*b*, 912*b*, and 913*b*, such as polyimide, which are respectively inserted into the flexible PCBs 911, 912, and 913 for insulation.

The conductor surface 911*a* of the first flexible PCB 911 and the conductor surface 913*a* of the third flexible PCB 913 are connected to each other through the plurality of through holes 940, so that leaky waves are isolated and the potential between respective layers is uniformly maintained, thereby implementing stable common ground surface characteristics.

As shown in FIG. 15, in the layered, flexible PCB strip line, the plurality of through holes 940 is spaced apart from the central conductor by a predetermined interval and is arranged at both end portions of the layered, flexible PCB strip line.

Although the present invention has been described in detail, the embodiments mentioned in the present invention are disclosed for illustrative purposes and the present invention is not limited thereto. Modifications or equivalent substituent elements of the present invention are included in the range of the present invention, without departing from the technical spirit or field of the invention disclosed in the accompanying claims.

The invention claimed is:

1. A multi-band built-in antenna for a mobile communication terminal having a main board and a casing for protecting the main board, the multi-band built-in antenna comprising:

a transmission line formed to be spaced apart from one outside surface of the main board by a predetermined interval and configured to include an external conductor, a dielectric, and a central conductor so as to transmit signals;

a radiator formed by bending the dielectric and central conductor of the transmission line, other than the external conductor of the transmission line, and configured to operate in multiple bands; and a ground clip for grounding the transmission line by fastening the transmission line and the main board.

2. The multi-band built-in antenna according to claim 1, wherein a plastic rib is formed so as to fix and support the radiator.

3. The multi-band built-in antenna according to claim 2, wherein the radiator is operated in dual bands.

4. The multi-band built-in antenna according to claim 1, wherein the radiator is formed in a meandering line.

5. A multi-band built-in antenna for a mobile communication terminal having a main board and a casing for protecting the main board, the multi-band built-in antenna comprising:

a transmission line formed to be spaced apart from one outside surface of the main board by a predetermined interval and configured to include an external conductor, a dielectric, and a central conductor so as to transmit signals;

a ground clip configured to ground the transmission line by fastening the transmission line; and a radiator formed by bending the dielectric and central conductor of the transmission line, other than the external conductor of the transmission line, and configured to operate in multiple bands.

6. The multi-band built-in antenna according to claim 5, wherein the ground clip comprises a first open stub formed so as to he parallel to the transmission line.

7. The multi-band built-in antenna according to claim 6, wherein the first open stub and the radiator are formed as a dipole structure.

8. The multi-band built-in antenna according to claim 7, wherein the first open stub is operated in mutual coupling with the transmission line.

9. The multi-band built-in antenna according to claim 5, wherein a plastic rib is formed so as to fix and support the radiator.

10. The multi-band built-in antenna according to claim 9, wherein the radiator is operated in dual bands.

11. The multi-band built-in antenna according to claim 5, wherein the radiator is formed in a meandering line.

12. A multi-band built-in antenna for a mobile communication terminal having a main board and a casing for protecting the main board, the multi-band built-in antenna comprising:

a transmission line formed to be spaced apart from one outside surface of the main board by a predetermined interval and configured to include an external conductor, a dielectric, and a central conductor so as to transmit signals;

a ground clip configured to ground the transmission line by connecting the transmission line and the main board;

a radiator formed by bending the dielectric and central conductor of the transmission line, and configured to operate in multiple bands; and a second open stub formed on the ground clip.

13. The multi-band built-in antenna according to claim 12, wherein the second open stub is formed so as to be symmetrical to the radiator, and part of one end of the second open stub is connected to the radiator.

14. The multi-band built-in antenna according to claim 13, wherein a folded dipole structure is formed between the second open stub and the radiator.

15. The multi-band built-in antenna according to claim 13, wherein the radiator is operated in dual bands.

16. The multi-band built-in antenna according to claim 12, wherein a plastic rib is formed so as to fix and support the radiator.

17. The multi-band built-in antenna according to claim 16, wherein the radiator is formed in a meandering line.

18. The multi-band built-in antenna according to claim 12, wherein the external conductor is formed so as to cover the radiator.

19. The multi-band built-in antenna according to claim 18, wherein the radiator is operated in mutual coupling with the external conductor.

20. A multi-band built-in antenna for a mobile communication terminal having a main board and a casing for protecting the main board, the multi-band built-in antenna comprising:

a transmission line formed along one side of the main board, and configured to include an external conductor, a dielectric, and a central conductor so as to transmit signals;

a ground clip configured to ground the transmission line by connecting the transmission line and the main board;

a radiator formed by bending the dielectric and central conductor of the transmission line, and configured to operate in a high frequency band; and a third open stub connected to the ground clip, bent a plurality of times, and configured to be operated in a low frequency band lower than the high frequency band;

wherein the radiator is spaced apart from the third open stub by a predetermined interval so as to be parallel thereto, and is configured to perform coupling feeding to the third open stub.

21. The multi-band built-in antenna according to claim 20, wherein broadband resonance characteristics occur in a low frequency band, in which the third open stub operates, depending on the interval between the third open stub and the radiator and a length of the radiator.

22. The multi-band built-in antenna according to claim 20, wherein the radiator is formed on one side of the third open stub to be parallel thereto, or is formed on an upper portion of the third open stub to be parallel thereto.

23. The multi-band built-in antenna according to claim 20, wherein the transmission line is a coaxial line in which cross sections of the external conductor, the dielectric, and the central conductor are formed in a circular shape, and the signals are transmitted through the central conductor.

24. The multi-band built-in antenna according to claim 20, wherein a transmission line is formed of a strip line in which cross sections of the external conductor, the dielectric, and the central conductor are formed in a square shape, the external conductor is formed so as to be a ground surface, the signals are transmitted through the central conductor provided in the center of the transmission line, and the external conductor and the central conductor are supported by the dielectric.

25. The multi-band built-in antenna according to claim 20, wherein:

a first flexible Printed Circuit Board (PCB), a second flexible PCB, and a third flexible PCB are vertically layered, the external conductor is formed by connecting conductor surfaces arranged on the outer circumferences of the first flexible PCB and the third flexible PCB, and a plurality of through holes, arranged and formed through the first to third flexible PCBs, the central conductor is buried in the center of the second flexible PCB while having a width corresponding to characteristic impedance; and the dielectric is formed by each of the flexible PCB dielectric layers.

26. The multiband built-in antenna according to claim 25, wherein the plurality of through holes is formed by being spaced apart from the central conductor by predetermined intervals and arranged at both end portions of the first to third flexible PCBs so as to be parallel therewith.

* * * * *